US007857961B2

(12) United States Patent
Hayashi et al.

(10) Patent No.: US 7,857,961 B2
(45) **Date of Patent: *Dec. 28, 2010**

(54) COPPER PLATING BATH FORMULATION

(75) Inventors: Shinjiro Hayashi, Saitama (JP); Hisanori Takiguchi, Saitama (JP)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/228,198

(22) Filed: Aug. 11, 2008

(65) Prior Publication Data

US 2009/0038951 A1 Feb. 12, 2009

(30) Foreign Application Priority Data

Aug. 10, 2007 (JP) ..... 2007-210531

(51) Int. Cl.
*C25D 3/38* (2006.01)
*C23C 18/40* (2006.01)

(52) U.S. Cl. ..... 205/291; 205/296

(58) Field of Classification Search ..... 205/291, 205/296; 106/1.26

See application file for complete search history.

(56) References Cited

U.S. PATENT DOCUMENTS

| | | | | |
|---|---|---|---|---|
| 2,931,760 | A * | 4/1960 | Westbrook | 205/296 |
| 4,336,114 | A * | 6/1982 | Mayer et al. | 205/298 |
| 5,908,543 | A * | 6/1999 | Matsunami et al. | 205/159 |
| 6,054,037 | A * | 4/2000 | Martin | 205/295 |
| 6,666,987 | B1 * | 12/2003 | Morikawa et al. | 252/79.4 |
| 6,709,564 | B1 | 3/2004 | Tench et al. | 205/291 |
| 6,793,796 | B2 | 9/2004 | Reid et al. | 205/102 |
| 6,946,065 | B1 | 9/2005 | Mayer et al. | 205/102 |
| 7,405,157 | B1 * | 7/2008 | Reid et al. | 438/677 |
| 2004/0156765 | A1 * | 8/2004 | Lalancette | 423/40 |
| 2009/0038949 | A1 * | 2/2009 | Hayashi et al. | 205/210 |

FOREIGN PATENT DOCUMENTS

| | | |
|---|---|---|
| DE | 1 072 860 | 1/1960 |
| SU | 819233 | 4/1981 |
| SU | 1010161 A1 | 4/1983 |
| WO | WO 01/24239 A1 | 4/2001 |

* cited by examiner

*Primary Examiner*—Edna Wong
(74) *Attorney, Agent, or Firm*—John J. Piskorski

(57) ABSTRACT

To provide a copper plating solution composition that precipitates copper plated membranes that are both uniform and smooth and which has good external appearance even if the copper plated membranes that are formed are relatively thin. The copper plating solution composition contains chlorine ions and bromide ions in specific volumes.

2 Claims, No Drawings

COPPER PLATING BATH FORMULATION

This invention relates in general to a copper plating solution. To give more detail, this invention relates to an acidic electrical plating solution and a method for the formation of copper-plated membranes using it such as is appropriate for the formation of copper-plated membranes of a thickness up about 20 μm.

There is a variety of industrial applications for the use of electrolytic copper plating. For example, it is also used for decorative-plated membranes and corrosion-protection membranes. Also, it is used in the electronic industry for the manufacture of printed circuit boards and semi-conductors. In the manufacturing of circuit boards, copper plating is utilized for the wiring layers that are formed on the surfaces of circuit boards and for the conductive layers of the wall surfaces of the through holes that perforate between the surfaces of the printed circuit boards.

In the electrolytic plating methods for the formation of a metal membrane on items such as copper-clad laminates, printed wiring boards, and wafers, electrolytic plating is generally performed having the object to be plated as one of the two electrodes and applying an electrical current between the electrodes within a plating bath. Generally an acidic copper plating solution contains copper ions that have dissolved out of a copper sulfide salt or such, a sufficient volume of electrolytes such as sulfuric acid so that the plating bath is conductive and polishing agents or copper precipitation accelerant agents (brighteners), high polarization agents (levelers), surfactant agents, precipitation-suppressant agents, etc., in order to improve the uniformity of the plated membrane.

In the electrolytic copper plating solution that is used in the manufacture of printed circuit boards, it is publicly known that it is possible to obtain uniformly deposited on the printed circuit board polished copper plating membranes by using polisher agents, leveling agents, surfactant agents, and such. Plating solutions to which polyalkylene oxide and chloride compound ions have been added (see for example U.S. Pat. No. 2,931,760) are known as the additives for copper sulfate and copper sulfate containing copper sulfate plating solution composition substances. In the patent document in question, it is disclosed that chloride compound ions and bromide compound ions have similar actions and that it is possible to use chloride compound ions and bromide compound ions as additives in copper plating solutions. However the patent document in question only discloses that it provides for obtaining uniform copper membranes with desirable characteristics by means of the combination of polyalkylene oxide and chlorine compound ions at a concentration of 0.02 g/l to 1.0 g/l, and it does not extend to disclosing the effects that can be obtained by means of specific volumes of the chloride compound ions and the bromide compound ions. It is also known that there are plating solutions for a sulfuric acid copper plating solution that do not contain organic additives and chloride compound ions and that contain bromide compound ions or iodine ions (see for example JP 63-186893) and that there are plating solutions that include alkylene oxide compounds and the reaction product(s) of epichlorohydrin (see for example JP 2004-250777).

However in recent years, because of fears of losing the folding characteristics and flexibility of boards when flexible printed circuit boards are manufactured using materials such as polyimide resins, there have come to be restrictions on the thickness of the conductivity circuitry layer that is formed on the board. However, in general when relatively thick layers of about 20 μm that are obtained using the heretofore technology are precipitated, it was not possible to obtain copper-plated layers with good external appearance and physical characteristics. That is to say, when the thickness of the copper-plated layer is thicker than about 20 μm, on the surface of the copper plating membrane, there was a difference in substrate metal layer surface roughness and the size of the precipitated copper-plated grain thus rendering difficult to obtain copper-plated membrane with uniform and quality luster.

The objective of this invention is to provide a copper plating method with which it is possible to provide the composition for a solution for electrical copper plating that is capable of the accumulation of copper plating membranes that have good luster and are flat and uniform. In particular, the objective of this invention is to provide the composition for copper plating solution and an electrolytic copper plating method with which it is possible to form copper plating membranes that have a uniformly precipitated and flat surface and a mirror finish for instances of copper plating for copper-clad laminates and the copper plating for the purpose of forming thin copper plating on the conductivity circuitry of printed circuit boards.

As a result of having carefully studied, for the purpose of solving the aforementioned problems, electrical copper plating solutions, the inventors have found that it is possible, by means of having specific proportions if halogen ions and chloride compound ions and bromide compound ions added to the electrically copper plating solution to deposit a copper plating membrane that is evenly precipitated with excellent polish and that has a smooth surface by treating the object to be plated with a liquid solution that contains bromide compound ions, and have achieved this invention.

This invention provides as one illustrative embodiment a copper plating solution composition wherein electrolytes, chloride compound ions, and bromide compound ions are contained and in which the contained volumes of the chloride compound ions and bromide compound ions within the above described copper plating solution are such as to fulfill the relationships of the equations (1), (2), and (3) described below:

Equation 1:

$$(Cl-30)/20<Br(130+Cl)/20 \quad (1);$$

$$50-Cl<10\times Br \quad (2);$$

$$10<Cl \quad (3)$$

In the equations, Cl is the concentration of the chloride compound ions (mg/l) in the ingredients of which the copper plating solution is composed; the Br is the concentration of the bromide compound ions (mg/l) in the components of the copper plating solution.

This invention provides a copper plating solution composition wherein electrolytes, chloride compound ions, and bromide compound ions are contained and in which the contained volumes of the chloride compound ions and bromide compound ions within the above described copper plating solution are such as to fulfill the relationships of the equations (4) and (5) described below.

Equation 2:

$$3\leqq Br\leqq(70+Cl)/15 \quad (4);$$

$$20\leqq Cl \quad (5)$$

Another illustrative embodiment of this invention is to provide a composition of a copper plating solution that contains copper ions, electrolytes and chloride compound ions and bromide compound ions wherein contained within the copper plating solution are 30 to 70 mg/l and the bromide compound ions are 1 to 10 mg/l.

Furthermore, this invention provides for a method of electrical copper plating wherein is included a process of applying an electrical current with the substrate as the negative electrode for a sufficient period of time for copper to be precipitate on the metal layer on the substrate in question after the substrate that is to be plated and either of the above described copper plating solutions are brought into contact.

It is possible by the use of the composition of the copper plating solution of this invention to precipitate a copper plating membrane that has an excellent external appearance, is evenly precipitated, and that has an even surface even when the precipitated copper plating membrane is relatively thick.

Hereinafter the details of this invention are explained. The composition of copper plating solution of this invention is that which contains copper ions, electrolytes, and chloride compound ions and bromide compound ions.

The abbreviations that are used throughout these specification have, unless specified to the contrary, the following meanings:

g=grams; mg=milligrams; ° C.=degrees Celsius; min=minute; m=meter; cm=centimeter; μm=micron (micrometer); l=liter; ml=milliliter; A=ampere; $mA/cm^2$=milliampere per square centimeter; ASD=ampere per square decimeter; $dm^2$=square decimeter. The ranges of all numerical values, unless specified to the contrary, include the threshold limit value; furthermore, arbitrary combination of order is possible. All volumes, unless specified to the contrary, are weight percentages and all ratios are based on weight.

In terminology used in these specification "plating solution" and "plating bath" have the same meaning and are interchangeable. The term "brightener" means an organic additive agent that has the action of increasing the precipitation speed of the electrolytic plating bath, and has the same meaning as the term "precipitation accelerant agent" and the term "polisher agent" and are interchangeable. The term "precipitation suppressant agent" has the same meaning as the term "carrier"; it means an organic additive agent that has the action of suppressing the copper plating precipitation speed in electrolytic plating. The term "leveler" or "leveling agent" means an organic compound that has the action of forming what is actually an evenly precipitated metal layer. The term "alkane," "alkanol," or "alkylene" indicates either straight chained or branched chain alkane, alkanol, or alkylene.

The copper ions in the course of this invention are at least partially soluble in the electrical plating bath and it preferable that they be provided by a copper ion source that is capable of providing copper ions. As sources of these copper ions, copper salts are preferred; as examples, copper sulfides, copper chloride, copper acetate, copper nitrate, copper fluoroborate, copper methanesulfonate, copper phenylsulfonate and p-toluenesulfonate can be cited. In particular, copper sulfate or copper methanesulfonate is preferable. The source of copper ions may be alone or in a combination of 2 or more. Such metal salts are generally sold on the market and may be used without refining.

The range of the volume of the copper ions contained within the composition of the copper plating solution is 1 g/l to 200 g/l, 5 g/l to 100 g/l being preferable, and 10 g/l to 75 g/l being more preferable.

For the electrolytes of this invention it is preferable for them to be acid; included are sulfuric acid, acetic acid, alkyl sulfonic acids such as fluoborate acid, methanesulfonic acid, ethanesulfonic acid, propanesulfonic acid and trifluromethanesufonic acid, allysulfonic acids such as phenylsulfonic acid, phenolsulfonic acid and toluenesulfonic acid, sulfamic acid, hydrochloric acid, and phosphoric acid. In particular, methanesulfonic acid is preferable. It is possible to supply these acids in the form of a metal salt or a halide; they may be alone or in a combination of 2 or more. Such electrolytes are generally sold on the market, and may be used without purification.

Normally the range of the volume of the electrolytes is 1 g/l to 500 g/l, preferably 5 g/l to 300 g/l, and more preferably 10 g/l to 250 g/l.

It preferable that the chloride compound ions in this invention be soluble in the plating bath and be of a chloride compound source that can provide chloride compound ions (chloride ions). As this source of chloride compound ions, it is possible to cite chloride compounds ions that do not adversely affect the pre-treatment solution and the copper plating bath such as hydrogen chloride, sodium chloride, copper chloride, ammonium chloride, lithium chloride, potassium chloride, and such. These bromide compound ion sources may be used alone or in a combination of 2 or more.

It preferable that the bromide compound ions in this invention be soluble in the plating bath and be of a bromide compound source that can provide bromide compound ions (bromide ions). As this source of bromide compound ions, it is possible to cite bromide compounds ions that do not adversely affect the pre-treatment solution and the copper plating bath such as hydrogen bromide, potassium bromide, sodium bromide, magnesium bromide, copper bromide (II), silver bromide, bromoform, carbon tetrabromide, ammonium bromide, tetraethylammonium bromide, and 1-ethyl-3-methyliomidazolium bromide. These bromide compound ion sources may be used alone or in a combination of 2 or more.

It is preferable that the concentrations of the chloride source ions and bromide compound ions of this invention, when the concentration of the chloride compound ions (mg/l) in the composition of the copper plating solution is Cl and the concentration of the bromide compound ions (mg/l) in the composition of the copper plating solution is Br, be such as to fulfill the relationship of (1) through (3) of the below described equations.

Equation 3:

$$(Cl-30)/20<Br<(130+Cl)/20 \quad (1)$$

$$50-Cl<10\times Br \quad (2)$$

$$10<Cl \quad (3)$$

Preferably it is such that the relationships between the below described (4) and (5) are fulfilled.

Equation 4:

$$3\leqq Br\leqq(70+Cl)/15 \quad (4)$$

$$20\leqq Cl \quad (5)$$

It is further preferable that the concentration be such as to fulfill the below described relationship of (6) and (7).

Equation 5:

$$3\leqq Br\leqq 6 \quad (6)$$

$$30\leqq Cl \quad (7)$$

Also, it is preferable when a soluble positive electrode is used in the electrical plating and the range of the concentration level of the chloride compound ions in the copper plating bath exceeds 10 mg/l and is within 30 mg/l for the bromide compound ions to be at 2 to 8 mg/l, when the range of the concentration of the chloride compound ions in the copper plating bath exceeds 30 mg/l and is within 70 mg/l for the bromide compound ions to be at 1 to 10 mg/l and when the range of the concentration of the chloride compound ions in the copper plating bath exceeds 70 mg/l and is within 100 mg/l for the bromide compound ions to be at 2 to 10 mg/l. When the range of the concentration level of the chloride compound ions in the copper plating bath exceeds 30 mg/l and is within 70 mg/l, it particularly preferable for the range of the concentration of the bromide compound ions to be in the range of 2 to 8 mg/l.

As sulfur atom containing organic compounds that may be contained in the pre-dip acidic aqueous solution, thiourea compounds, benzothiazole compounds, and such that contain 1 or several sulfur atoms can be cited. Included amongst the organic compounds that have sulfides or sulfonic acid group are, for example, compounds that contain a —S—($CH_2O$—R—$SO_3$ M structure within the molecule or that contain —S—R—$SO_3M$ structure (in the formula, the M is hydrogen or an alkyl metal atom and the R is an alkylene group that contains from 3 to 8 carbon atoms). Specifically the following can be cited as examples: N,N-dimethyl-dithiocarbamic acid-(3-sulfopropyl) ester; 3-mercapto-propylsulfonic acid-(3-sulfopropyl) ester; 3-mercapto-propylsulfonoic acid sodium salt; 3-mercapto-propylsulfonic acid sodium salt; carbon-dithio-o-ethyl ester; bis-sulfoniocpropyldisulfide; bis-(3-sulfonepropyl-disulfide disulfide di-sodium salt; 3-(benzothiazolyl-s-thio)propylsulfone acid sodium salt; pyridinium propylsulfobetaine; 1-sodium-3-mercaptopropane-1-sulfonate; N,N-dimethyl-dithiocarbamic acid-(3-sulfoethyl) ester; 3-mercapto-ethylpropylsulfonic acid-(3-sulfoethyl); 3-mercapto-ethylsulfonic acid sodium salt; 3-mercapto-1-ethane sulfonic acid potassium salt; carbon-dithio-o-ethyl ester-s-ester; bis-sulfoethyldisulfide; 3-(benzothiazolyl-s-thio) ethyl sulfonic acid sodium salt; pyridinium thiethylsulfobetaine; 1-sodium-3-mercaptoethane-1-sulfonate.

It is possible to use a precipitation accelerant agent in a variety of volumes; the volume to be used per each liter of the plating bath may be at least 1 mg, preferably at least 1.2 mg and more preferably at least 1.5 mg. For example, the volume of precipitation accelerant agent exists in the copper plating bath in the range of 1 mg/l to 200 mg/l. The volume of precipitation accelerant agent in the copper plating bath of this invention that is particularly useful is 50 mg/l.

As examples of the aforementioned surfactant agents, surfactant agents of the anionic series, cationic series, non-ionic series or amphoteric series can be cited; in particular the non-ionic surfactant agents are preferable. The preferable non-ionic surfactant agents are polyethers that contain within 1 molecule ether oxygen atoms. Specifically, for example, polyoxyalkylene additives such as polyoxyethylene lauryl ether, polyethylene glycol, polypropylene glycol, poly-oxyethylene alkyl ether, polyoxyethylenepolyoxypropyleneglycol, polyoxyethylene nonyl-phenylether, polyoxyethylenepolyoxypropylenealkylamine and ethylenediamine can be cited; the preferable ones are polyoxyethylenemonobutylether, polyoxypropylenemonobutylether, polyoxyethylene polyoxypropyleneglycolmonobutylether, etc., of polyoxyethylenemonoalkyl ether, polyethylenegycol or phenylethoxylate with 5 to 500 repeating units. Such additive agents may be used alone or in a combination of 2 or more.

When surfactant agents are used in the copper plating solution, it is appropriate for the concentration level to be at 0 g/l or greater and 50 g/l or less, preferable for it to be 0.05 g/l or greater and 20 g/l or less and more preferable for it to be 0.1 g/l or greater and 15 mg/l or less.

The copper plating solution composition of the present invention can use as additives to the copper plating solution, in addition to those described above, additives such as any leveling agent or copper precipitation inhibiting agents common in the art. The leveling agent can be a primary, secondary, or tertiary amine. These include alkylamine, dialkylamine, trialkylamine, arylalkylamine, imidazole, triazole, tetrazole, benzimidozole, benzotriazole, piperidine, morpholine, piperazine, oxazole, benzoxazole, pyrimidine, quinoline, and isoquinoline. If a leveling agent is used in the plating bath, the concentration should range between 0 g/l and 50 g/l, preferably between 0.05 g/l and 20 g/l, and more preferably between 0.1 g/l and 15 g/l . Reaction products of imidazole and alkylene oxide can also be used, including the imidazole, diethylenegylcol, and epichlorhydrin reaction products disclosed in Unexamined Patent Application 2004-250777.

For the components of the copper plating solution, it is possible to prepare by means of adding the aforementioned components in an at will order. For example, it is preferable to add the copper ion source and electrolytes to the water, followed by an addition of the chloride compound ions and the bromide compound ions, and, if necessary, the addition of the leveling agent, the precipitation accelerant agent, the surfactant agent, and such.

The copper plating method of this invention is performed by bringing into contact the object to be plated and the copper plating solution, and performing the electrical plating using the object to be plated as a cathode. As for the electrical plating method, it is possible to use publicly known methods. The concentration levels of each of the aforementioned components are adjusted for the plating method—barrel plating, through-hole plating, rack plating, high-speed continuous plating, etc.

It is possible to perform the aforementioned electrical plating method with the plating bath temperature at 10° C. to 65° C. and preferably at ambient temperature to 50° C. Also, the cathode current density can be appropriately selected to be in the 0.01 to 100 $A/dm^2$ and preferably in the 0.05 to 20 $A/dm^2$ ranges.

The copper plating membrane can be precipitated with the composition for a copper plating solution of the invention using an electroplating method to obtain the desired thickness, for example, 20 μm or less, preferably 15 μm or less, and more preferably 12 μm or less.

Although it is acceptable for no stirring to occur in the plating bath between the electrical plating processes, it also possible to select a method such as stirring by means of a vibration of the objects being processed, stirrer, etc., flow movement by means of a pump, air stirring, etc.

The copper plating method of this invention is one that can be used for any object to be plated wherein it is possible to electrically plate copper. As examples of such objects to be plated, it is possible to cite printed circuit boards, integrated circuits, semi-conductor packages, lead frames, inter-connectors, etc. In particular, it is useful in lead frames, flexible printed circuit boards, and such, wherein there is accumulation of relatively thin copper.

With the copper plating method of this invention it is possible to accumulate copper-plated membranes that are free of dimple-shaped pitting, have excellent luster, are evenly precipitated and have flat surfaces even if the membrane thickness is 20 μm or less, preferably 15 μm or less, and more preferably 12 μm or less.

This invention is explained by means of the following working examples, but these are merely working examples and as such do not restrict the scope of this invention.

WORKING EXAMPLE 1

The following compounds were added to de-ionized water to prepare a pre-treatment liquid solution.

TABLE 1

| | |
|---|---|
| Copper Sulfate Penta-Hydrate | 75 g/l (19.1 g/l as copper) |
| Sulfuric Acid | 190 g/l |
| Hydrogen Chloride | 51.4 mg/l (50 mg/l as chloride compound ions) |
| Sodium Bromide | 2.58 mg/l (2 mg/l as bromide compound ions) |
| Bis-(3-Sulfopropyl)-Disulfide Disodium Salt | 4 mg/l |
| Polyoxyethylenepolyoxypropylene-glycolmonobutylether (weight-average molecular weight 1100) | 1.5 g/l |
| De-ionized Water | Residual |
| PH Value | 1> |

With the rolled copper foil to be plated as the negative electrode and a positive electrode that is soluble in that which contains copper phosphorus, electrical plating was performed in the above described copper plating bath, under conditions wherein the solution temperature was 25° C. and the electrical current density was 2 ASD, an 8-μm thickness copper plating membrane was precipitated while air stirring.

The obtained copper-plated membranes were subject to gross examination and metal microscope (PME Type 3) examination. The membranes had more even and flat surfaces, and the exterior showed a mirror gloss with no dimple-shaped pits.

WORKING EXAMPLE 4

Copper-plated membranes (8-μm) were precipitated with a copper plating solution in the same manner as in Working Example 1 except that 2 mg/l of N,N-dimethyl-dithiocarbamisdulfonic acid chloride was substituted for bis-(3-sulfopropyl)-disulfide disodium salt.

The obtained copper-plated membranes had uniform and flat surfaces, and the exterior showed a mirror gloss with no dimple-shaped pits.

TABLE 2

| | |
|---|---|
| Copper Sulfate Penta-Hydrate | 75 g/l (19.1 g/l as copper) |
| Sulfuric Acid | 190 g/l |
| Hydrogen Chloride | 51.4 mg/l (50 mg/l as chloride compound ions) |
| Bromide Compound of Table 1 | Table 1 |
| Bis-(3-Sulfopropyl)-Disulfide Disodium Salt | 4 mg/l |
| Polyoxyethylenepolyoxypropylene-glycolmonobutylether (weight-average molecular weight 1100) | 1.5 g/l |
| Reaction Product of Imidazole and Diethyleneglycol and Epichlorohydrin Disclosed in Published Unexamined Patent Application 2004-250777 | 75 mg/l |
| De-ionized Water | Residual |
| PH Value | 1> |

Copper plating membranes of an 8 μm thickness were precipitated by means of the same method as Working Example 1 and the membranes were examined.

TABLE 3

| Additive Agents | Additive Volume | Bromide Compound Ions | Uniformity | Flatness | External Appearance |
|---|---|---|---|---|---|
| Copper Bromide (II) | 3.58 mg/l | 2 mg/l | Good | Good | No dimple-shaped pitting |
| Hydrobromic Acid | 2.03 mg/l | 2 mg/l | Good | Good | No dimpled-shaped pitting |
| Bromopropionic Acid | 19.15 mg/l | 10 mg/l | Good | Good | No dimpled-shaped pitting |
| Bromo Thymol Blue | 7.81 mg/l | 2 mg/l | Good | Failed | Failed |

WORKING EXAMPLE 2

Copper-plated membranes (8-μm) were precipitated with a copper plating solution in the same manner as in Working Example 1 except that 1.5 g/l of polyethylene glycol # 12000 (weight average molecular volume 12,000) was substituted for polyoxyethyleleoxypropylene glycol.

The obtained copper-plated membranes had uniform and flat surfaces, and the exterior showed a mirror gloss with no dimple-shaped pits.

WORKING EXAMPLE 3

A copper plating solution was prepared such that 75 mg/l of imidazole and diethyleneglycol and epichlorohidrine and the results of the reaction that are disclosed in Unexamined Patent Application 2004-250777 were added to the copper plating solution of Working Example 1. Copper-plated membranes (8-μm) were precipitated with a copper plating solution in the same manner as in Working Example 1. The obtained copper-plated membranes had uniform and flat surfaces, and the exterior showed a mirror gloss with no dimple-shaped pits.

COMPARATIVE EXAMPLE 1

As a copper plating solution that does not contain bromide compound ions, a copper plating solution was prepared by means of the addition of the following compounds to de-ionized water; then copper-plated membranes (8 μm) were precipitated in the same manner as in Working Example 1, and the membranes were examined.

TABLE 4

| | |
|---|---|
| Copper Sulfate Penta-Hydrate | 75 g/l (19.1 g/l as copper) |
| Sulfuric Acid | 190 g/l |
| Hydrogen Chloride | 51.4 mg/l (50 mg/l as chloride compound ions) |
| Bis-(3-Sulfopropyl)-Disulfide Disodium Salt | 4 mg/l |
| Polyoxyethylenepolyoxypropylene-glycolmonobutylether (weight-average molecular weight 1100) | 1.5 g/l |
| De-ionized Water | Residual |
| pH Value | 1> |

Although the obtained copper-plated membranes were overall evenly precipitated and the precipitated portions had smooth surfaces, there were dimple-shaped pits and it was not possible to obtain a mirror-gloss.

COMPARATIVE EXAMPLES 2-4

Excluding the fact that sodium bromide is not contained, the copper plating solution was prepared in the same manner as in Working Examples 2 through 4 and the copper-plated membranes (8 μm) were precipitated using the same method as in Working Example 1.

The obtained copper-plated membranes were overall evenly precipitated and the precipitated portions had smooth surfaces but there were numerous dimple-shaped pits and the membranes obtained did not have a mirror-gloss.

WORKING EXAMPLE 6

The copper plating solution was prepared by adding the following compound(s) and the bromide compound ions described in Table 1 and the copper plating membranes (8 μm) were precipitated in the same manner as Working Example 1.

TABLE 5

| | |
|---|---|
| Copper Sulfate Penta-Hydrate | 75 g/l (19.1 g/l as copper) |
| Sulfuric Acid | 190 g/l |
| Hydrogen Chloride | 51.4 mg/l (50 mg/l as chloride compound ions) |
| Bis-(3-Sulfopropyl)-Disulfide Disodium Salt | 2.58 mg/l (2 mg/l as bromide compound ions) |
| Polyoxyethylenepolyoxypropylene-glycolmonobutylether | 4 mg/l |
| (weight-average molecular weight 1100) | 1.5 g/l |
| Reaction Product of Imidazole and Diethyleneglycol and Epichlorohydrin Disclosed in Published Unexamined Patent Application 2004-250777 | 75 mg/l |
| De-ionized Water | Residual |
| pH Value | 1> |

The obtained copper-plated membranes were subject to gross examination and metal microscope (PME Type 3) examination. The membranes had more even and flat surfaces, and the exterior showed a mirror gloss with no dimple-shaped pits.

COMPARATIVE EXAMPLE 5

Excluding the fact that sodium bromide is not contained, the copper plating solution was prepared in the same manner as in Working Example 6 and the copper-plated membranes were obtained using the same method as in Working Example 1.

The obtained copper plated membranes had more even and flat surfaces but the membranes were those in which there were numerous dimple-shaped pits and lacking mirror gloss.

WORKING EXAMPLE 6

Chloride compound ions and bromide compound ions were added to the prepared copper plating solution in accordance with that which is shown in the following Table 6. The composition of the prepared copper plating solution was as follows:

TABLE 6

| | |
|---|---|
| Copper Sulfate Penta-Hydrate | 75 g/l (19.1 g/l as copper) |
| Sulfuric Acid | 190 g/l |
| Hydrogen Chloride | Table 2 |
| Bis-(3-Sulfopropyl)-Disulfide Disodium Salt | Table 2 |
| Polyoxyethylenepolyoxypropylene-glycolmonobutylether | 4 mg/l |
| (weight-average molecular weight 1100) | 1.5 g/l |
| Reaction Product of Imidazole and Diethyleneglycol and Epichlorohydrin Disclosed in Published Unexamined Patent Application 2004-250777 | 75 mg/l |
| De-ionized Water | Residual |
| pH Value | <1 |

After the rolled copper foil to be plated was surface processed for 3 minutes in a acidic degreasing bath at 40° C. and water washed, it was dipped for 1 minute in a 10% concentration sulfuric acid aqueous solution at 25° C. Then electrical plating was conducted using the rolled copper foil as a negative electrode and a positive electrode that is soluble in phosphor copper, an 8-μm thickness copper plating membrane was precipitated while stirring (type of stirrer) under solution temperature 25° C. and electrical current density of 3 ASD conditions. The obtained copper-plated membranes were subjected to a gross examination; the results thereof are shown in Table 7.

TABLE 7

| Chloride Compound Ion Concentration mg/l | Bromide Compound Ion Concentration mg/l | Uniformity and Evenness | External Appearance |
|---|---|---|---|
| 0 | 0 | Failed | Failed |
| | 0.75 | Failed | Failed |
| | 10 | Failed | Failed |
| 10 | 0 | Failed | Failed |
| | 1 | Failed | Failed |
| | 2 | Failed | Failed |
| | 4 | Failed | Failed |
| | 10 | Failed | Failed |
| 20 | 0 | Failed | Failed |
| | 1 | Failed | Failed |
| | 2 | Failed | Failed |
| | 4 | Good | Good |
| | 6 | Good | Good |
| | 10 | Failed | Failed |
| 25 | 0.75 | Failed | Failed |
| | 2 | Good | Good |
| | 3 | Failed | Failed |
| | 8 | Failed | Failed |
| 30 | 0 | Failed | Failed |
| | 1 | Failed | Failed |
| | 2 | Failed | Failed |
| | 4 | Good | Good |
| | 6 | Good | Good |
| | 8 | Failed | Failed |
| 50 | 0 | Failed | Failed |
| | 0.5 | Failed | Failed |
| | 0.75 | Failed | Failed |
| | 1 | Failed | Failed |
| | 1.5 | Good | Good |
| | 2 | Good | Good |
| | 3 | Good | Good |
| | 4 | Good | Good |
| | 6 | Good | Good |
| | 8 | Good | Good |
| | 10 | Failed | Failed |
| 70 | 1 | Failed | Failed |
| | 2 | Failed | Failed |
| | 4 | Good | Good |
| | 8 | Good | Good |
| | 10 | Failed | Failed |

TABLE 7-continued

| Chloride Compound Ion Concentration mg/l | Bromide Compound Ion Concentration mg/l | Uniformity and Evenness | External Appearance |
|---|---|---|---|
| 100 | 0 | Failed | Failed |
| | 1 | Failed | Failed |
| | 2 | Failed | Failed |
| | 4 | Good | Good |
| | 10 | Good | Good |
| | 15 | Failed | Failed |

From the above described results, when chloride compound ions and bromide compound ions existed in specific volumes in the copper plating solution, the precipitated copper plating membranes that was accumulated were both uniform and smooth, and the surface of the copper plating membranes that were obtained also had an external appearance of a mirror luster.

What is claimed is:

1. A method of electroplating copper on a substrate comprising:

a) providing a copper electroplating solution comprising copper ions, electrolytes, chloride ions and bromide ions, the concentration of the chloride ions and the bromide ions in the copper electroplating solution fulfill the relationship in the following equations:

$$3 \leqq Br \leqq 6 \quad (6)$$

$$30 \leqq Cl \quad (7)$$

wherein the Cl is the concentration of the chloride ions in mg/l in the copper electroplating solution and the Br is the bromide ion concentration in mg/l in the copper electroplating solution;

b) placing a positive electrode in the copper electroplating solution;

c) placing the substrate as a negative electrode in the copper electroplating solution;

d) applying an electrical current through the copper electroplating solution and the positive and negative electrodes; and e) electroplating a copper metal layer on the substrate, the copper metal layer is 20 μm or less thick.

2. The method of claim 1, wherein the copper metal layer is 15 μm to 8 μm thick.

* * * * *